United States Patent [19]

Hohenstein

[11] Patent Number: 4,939,626

[45] Date of Patent: Jul. 3, 1990

[54] DISPOSABLE FLASHLIGHT

[75] Inventor: Matthaus T. Hohenstein, Milan, Italy

[73] Assignee: Tecmavest Maschinen AG, Zug, Switzerland

[21] Appl. No.: 424,806

[22] Filed: Oct. 20, 1989

[51] Int. Cl.[5] ..... F21L 7/00

[52] U.S. Cl. ..... 362/189; 362/186; 362/205

[58] Field of Search ..... 362/158, 186, 189, 194, 362/202, 205

[56] References Cited

U.S. PATENT DOCUMENTS

| | | | |
|---|---|---|---|
| 2,236,384 | 3/1941 | Samuels | 362/189 X |
| 2,681,979 | 6/1954 | Manoloff | 362/186 X |
| 4,237,527 | 12/1980 | Breedlove | 362/189 |

*Primary Examiner*—Stephen F. Husar

*Attorney, Agent, or Firm*—Brumbaugh, Graves, Donohue & Raymond

[57] ABSTRACT

A disposable flashlight uses a cylindrical battery as the flashlight body. A bulb fixture is affixed directly to one end of the battery and provides electrical contact between one terminal of the bulb and one terminal of the battery, and between the other terminal of the bulb and a conducting portion of the bulb fixture. A normally open switch affixed to the sidewall of the battery has one terminal connected to the conducting portion of the bulb fixture and another terminal connected to the other terminal of the battery, such that when the switch is closed by the application of pressure thereon, a circuit is completed to energize the bulb. A relatively thin, pliable, insulating material covers substantially the entire sidewall of the battery, including the connections to the switch.

5 Claims, 1 Drawing Sheet

DISPOSABLE FLASHLIGHT

BACKGROUND OF THE INVENTION

The present invention relates to flashlights energized by batteries, and more particularly to disposable flashlights, which are intended to be completely discarded after the battery is exhausted.

Prior art flashlights typically comprise a rigid casing, which serves as the structural body of the flashlight as well as the container for one or more batteries. The casing generally includes or houses a fixture for holding a bulb, a switch and associated conductors for connecting the bulb with the one or more batteries and the switch in a circuit, in which the bulb is energized by the batteries when the switch is closed. Ordinarily, the flashlight casing, the bulb fixture and the switch are reusable, and the casing is designed to permit replacement of the battery or batteries and the bulb. In some instances, the bulb fixture, along with any associated reflector and/or lens, is detachable from the casing as a unit to facilitate replacement of components contained therein.

Known disposable flashlights also use a rigid casing or other rigid encapsulation to serve as the flashlight body and to hold the battery or batteries. Such flashlights also have a bulb fixture for holding a bulb, a switch and associated conductors for connecting the bulb fixture with the battery or batteries and the switch. However, the construction of the disposable flashlight is such that neither the bulb nor the battery or batteries are readily replaceable, since the disposable flashlight is designed to be completely discarded when the battery or batteries are exhausted or if the bulb fails. Furthermore, the construction technique, the material used for the casing and other components, the configurations of the bulb fixture and switch are all designed to achieve a low manufacturing cost, and therefore a relatively inexpensive selling price for the flashlight. However, the use of a rigid casing or other rigid encapsulation in known disposable flashlights significantly increases the manufacturing cost of such flashlights.

SUMMARY OF THE INVENTION

In accordance with the invention there is provided an improved disposable flashlight comprising a battery which serves as the body of the flashlight. A bulb fixture is affixed to the external surface of the battery for holding a bulb and for providing electrical contact between one terminal of the bulb with one terminal of the battery, the bulb fixture having a conducting portion for making electrical contact with the other terminal of the bulb. An on/off switch is affixed to the external surface of the battery, the switch having two terminals of which one is connected through a first strip-like conductor to the other terminal of the battery and the other is connected through a second strip-like conductor to the conducting portion of the bulb fixture. The strip-like conductors are both affixed to the external surface of the battery, and a relatively thin, pliable, insulating material covers substantially all of the exposed external surface of the battery and the strip-like conductors.

In an exemplary embodiment of the disposable flashlight, the battery has a substantially cylindrical shape with two opposing ends and a sidewall. The two terminals of the battery are disposed at respective opposite ends thereof. The bulb fixture, which has a generally cylindrical shape and a concave reflecting surface, is affixed to one end of the battery. The bulb fixture has a threaded aperture at the center of the concave reflecting surface, which passes through the conducting portion of the bulb fixture and provides access to one of the terminals of the battery. The threaded aperture mates with a threaded base of the bulb, which serves as one of the terminals of the bulb. The other terminal of the bulb is positioned at the end of the threaded base, such that when the bulb is threaded into the aperture of the bulb fixture, one terminal of the bulb makes electrical contact with the conducting portion of the bulb fixture, while the other terminal of the bulb makes electrical contact with one terminal of the battery. The switch, which is affixed to the sidewall of the battery, has first and second metal contacts separated by resilient means, the first and second contacts each having a portion serving as the first and second switch terminals, respectively. The first strip-like conductor comprises a thin metal strip extending along the sidewall of the battery from the first switch terminal to the conducting portion of the bulb fixture, and the second strip-like conductor comprises a thin metal strip extending along the sidewall of the battery from the second switch terminal to the other terminal of the battery. A sheet of pliable, insulating material is wrapped around the sidewall of the battery to cover substantially all of the sidewall and the metal strips, and there is included a generally cylindrical, cup-shaped, lens affixed to the one end of the battery to cover the bulb fixture and the bulb.

BRIEF DESCRIPTION OF THE DRAWINGS

The present invention can be better understood from the following detailed description of an exemplary embodiment taken in conjunction with the accompanying drawings, in which.

DESCRIPTION OF THE PREFERRED EMBODIMENT

Figure 1:
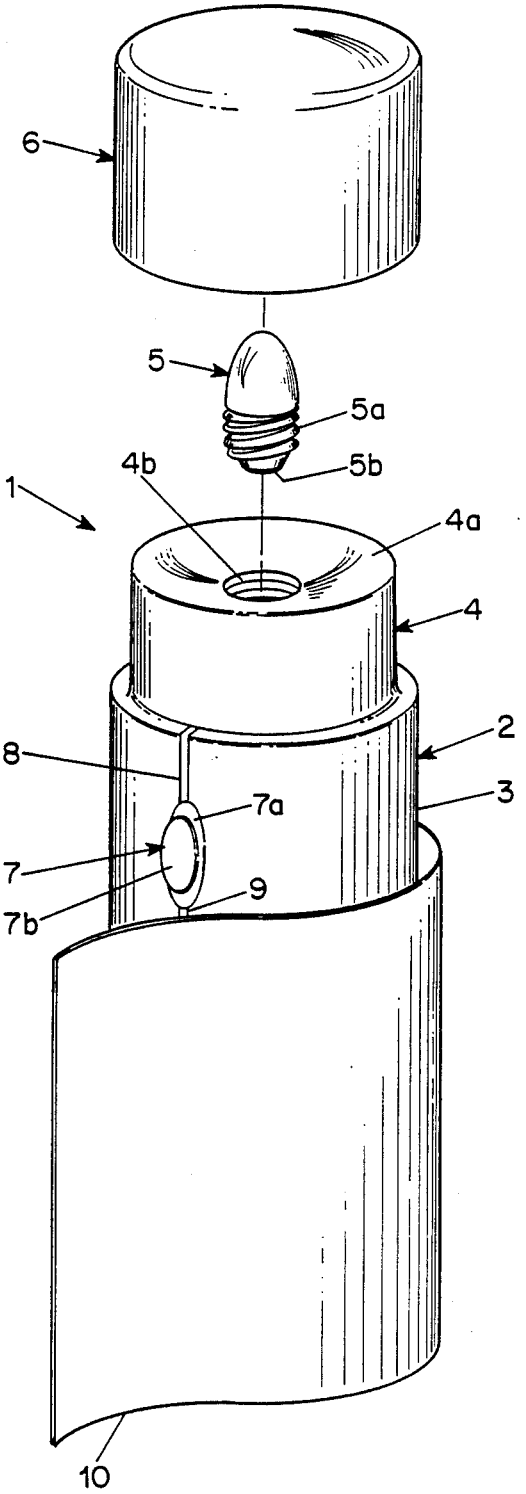
FIG. 1 is an isometric, partially-exploded view of a disposable flashlight in accordance with the present invention.
Figure 2:
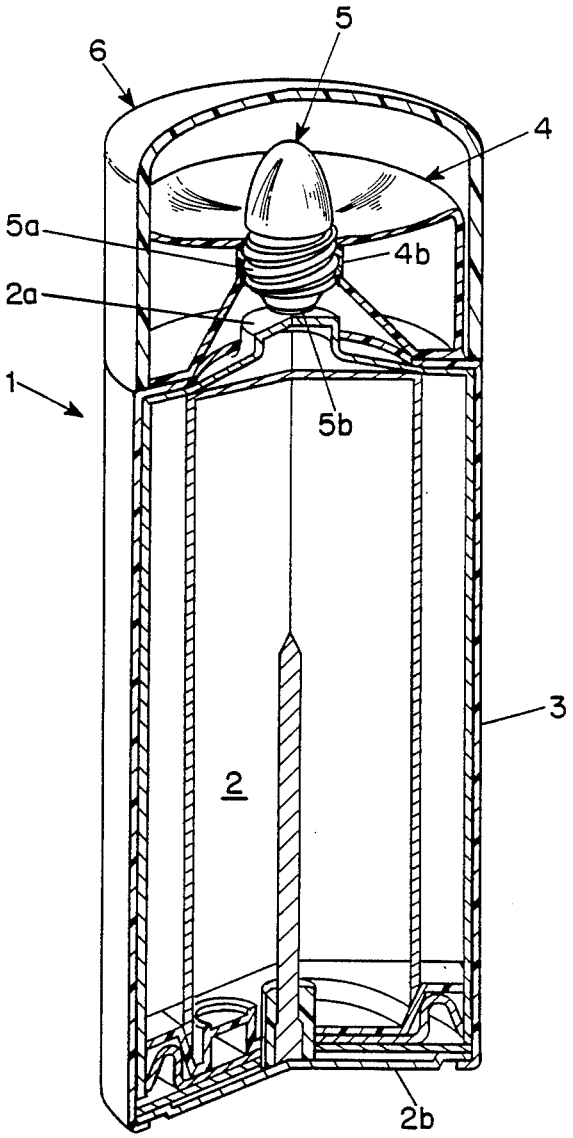
FIG. 2 is a partially cutaway, isometric view of the disposable flashlight of FIG. 1.

In the exemplary embodiment of the invention shown in FIGS. 1 and 2, a cylindrical battery 2 having a positive terminal 2*a* and a negative terminal 2*b* (shown in FIG. 2) located at opposing ends thereof functions as the structural body as well as the energy source for a disposable flashlight 1. An on/off switch 7 and associated conductors 8 and 9 are attached to the sidewall 3 of the battery 2, with a metal strip 8 running from the bulb fixture 4 to one terminal of the switch 7 and another metal strip 9 running from another terminal of the switch 7 to the negative terminal 2*b* of the battery 2. Referring to FIG. 1, a generally cylindrical bulb fixture 4 for holding a bulb 5 is affixed to the upper end of the battery 2, as shown. A cylindrical, cup-shaped lens 6 is placed over the bulb 5 and bulb fixture 4, with the open end of the lens 6 then being attached to the upper end of the battery 2. The sidewall 3 of the battery 2, as well as the exposed portions of the conductors 8 and 9, are all covered by a relatively thin, pliable, insulating material 10.

As shown in FIG. 2, the battery 2 is a conventional dry cell of any appropriate size or shape (e.g., an A, B, C or D cell), preferably of a long-life type, such as an alkaline or a lithium cell. The covering material 10 may be thin cardboard, paper or pliable plastic in the form of a tube or sheet. Other suitable covering materials include PVC, rubber or insulating paint. The method of applying the protective material 10 depends upon the type of material used. For example, paint or other initially liquid coatings may be applied by spraying or dipping, while a sheet material may be wrapped around the sidewall of the battery 2 and held with a suitable adhesive. The conductors 8 and 9 are preferably thin metal strips, but may be composed of any appropriate conductive material formed by conventional techniques, such as silk screening. The on/off switch 7 may be any one of a variety of known, low-cost switch configurations which are normally open but which close upon the application of pressure. Such switches typically include a pair of metal contacts 7a and 7b which are separated by resilient means. Examples of such switches may be found in the keys of inexpensive electronic calculators.

As shown in FIG. 1, the bulb housing 4 has a concave reflecting upper surface 4a having a centrally located threaded aperture 4b, which mates with the threaded metal base 5a of the bulb 5. At least a portion of the material of the bulb fixture 4 through which the threaded aperture 4b is formed must be conductive so as to make electrical contact with the metal base 5a of the bulb 5 when the bulb is threaded into the aperture 4b. The threaded metal base 5a of the bulb 5 serves as one terminal thereof, while the other terminal 5b of the bulb 5 is located adjacent the end of the metal base 5a. The conductive portion of the bulb fixture 4, which provides electrical contact to the metal base 5a of the bulb 5, is connected to the conductor 8. As shown in FIG. 2, the aperture 4b exposes the positive terminal 2a of the battery such that when the bulb 5 is threaded into the aperture 4b, the other terminal 5b of the bulb 5 makes electrical contact with the positive battery terminal 2a.

A cylindrical, cup-shaped, generally clear lens 6 is placed over the bulb 5 and bulb fixture 4, and is attached to the upper end of the battery 2 by suitable means, such as by press fitting or by using a suitable adhesive. Although a generally clear, cylindrical, cup-shaped lens 6 is preferred, other types of lenses appropriate for flashlights may be used.

Although the invention has been described with reference to a specific embodiment, various modifications and alterations thereto will readily occur to those skilled in the art without departing from the scope of the invention, as defined by the appended claims. For example, the battery may have various shapes other than cylindrical, and the terminals of the bulb may have other configurations, such as wires which are attached by soldering or welding directly to the positive terminal of the battery and to the conductor connecting the switch. Furthermore, the disposable flashlight according to the invention need not have a lens covering the bulb or a reflecting surface associated with the bulb fixture.

I claim:

1. A disposable flashlight comprising:

a battery having first and second terminals disposed on an external surface thereof;

bulb fixture means affixed to the external surface of the battery and being adapted to hold a bulb having a first and a second bulb terminal, the bulb fixture providing electrical contact between the first bulb terminal and the first terminal of the battery, and having a conducting portion for making electrical contact to the second bulb terminal;

a switch affixed to the external surface of the battery, the switch having a first and a second switch terminal;

first and second conducting means affixed to the external surface of the battery for making electrical connections between the first switch terminal and the conducting portion of the bulb fixture, and between the second switch terminal and the second terminal of the battery, respectively, whereby when the switch is closed, the bulb is energized by the battery; and a relatively thin, pliable, insulating material covering at least exposed portions of the external surface of the battery and the first and second conducting means.

2. A disposable flashlight according to claim 1, wherein the battery has a generally cylindrical shape having opposing first and second ends and a sidewall, the first and second terminals of the battery being respectively disposed on the first and second opposing ends, the bulb fixture being affixed to the first end of the battery, the switch being affixed to the sidewall of the battery, the first and second conducting means respectively comprising first and second strip-like conductors extending from the first switch terminal to the conducting portion of the bulb fixture and from the second terminal of the battery to the second switch terminal, and the relatively thin, pliable, insulating material covering substantially all of the sidewall of the battery and the first and second strip-like conductors.

3. A disposable flashlight according to claim 2, wherein the bulb fixture has a generally cylindrical shape and a concave reflecting surface at one end thereof, the bulb fixture having a threaded aperture positioned at the center of the reflecting surface and exposing the first terminal of the battery, the bulb having a threaded metallic base for mating with the threaded aperture of the bulb fixture and forming the second bulb terminal, the first bulb terminal being disposed adjacent the end of the threaded base, whereby when the bulb is threaded into the aperture of the bulb fixture, the second bulb terminal makes electrical contact with the conducting portion of the bulb fixture while the first bulb terminal extends to make electrical contact with the first terminal of the battery.

4. A disposable flashlight according to claim 3, further comprising a generally cylindrical, cup-shaped lens affixed to the one end of the battery covering the bulb fixture and the bulb.

5. A disposable flashlight according to claim 1, wherein the switch comprises first and second metal contacts separated by resilient means, the first metal contact having a portion serving as the first switch terminal, the second metal contact having a portion serving as the second switch terminal, the first conducting means comprising a first thin metal strip extending along the sidewall of the battery from the first switch terminal to the conducting portion of the bulb fixture, and the second conducting means comprising a second thin metal strip extending along the sidewall of the battery from the second switch terminal to the second terminal of the battery.

* * * * *